US007516629B2

(12) United States Patent
Behrens et al.

(10) Patent No.: US 7,516,629 B2
(45) Date of Patent: Apr. 14, 2009

(54) LAUNDRY APPLIANCE HAVING AUTOMATIC START FEATURE BASED ON SELECTED STAIN

(75) Inventors: Jan D. Behrens, Kellogg, IA (US); Nedra A. Herr, Newton, IA (US); Kimberly J. Hood, Mitchellville, IA (US); Kristi R. Lafrenz, Newton, IA (US); Brian L. Ness, Newton, IA (US); Brett C. Oleson, Newton, IA (US); Stephen D. Schober, Newton, IA (US); Lashelle D. Woods, Newton, IA (US)

(73) Assignee: Whirlpool Corporation, Benton Harbor, MI (US)

( * ) Notice: Subject to any disclaimer, the term of this patent is extended or adjusted under 35 U.S.C. 154(b) by 1401 days.

(21) Appl. No.: 10/337,372

(22) Filed: Jan. 7, 2003

(65) Prior Publication Data

US 2003/0154560 A1 Aug. 21, 2003

Related U.S. Application Data

(63) Continuation-in-part of application No. 09/919,793, filed on Aug. 2, 2001, now Pat. No. 6,671,916, and a continuation-in-part of application No. 09/741,067, filed on Dec. 21, 2000, now Pat. No. 6,502,265.

(51) Int. Cl.
*D06F 33/00* (2006.01)

(52) U.S. Cl. ..... 68/12.12; 68/12.27

(58) Field of Classification Search ..... 68/12.12, 68/12.27; 700/83, 17
See application file for complete search history.

(56) References Cited

U.S. PATENT DOCUMENTS 4,084,237 A 4/1978 Beachem et al.

(Continued)

FOREIGN PATENT DOCUMENTS

GB 2199676 7/1988

(Continued)

OTHER PUBLICATIONS

Tide Website, www.tide.com/fabric/stainDet, Proctor & Gamble.

(Continued)

*Primary Examiner*—Joseph L. Perrin
(74) *Attorney, Agent, or Firm*—Cliff Green; Michael D. Lafrenz

(57) ABSTRACT

A laundry appliance can be selectively operated in either manual or automatic modes of operation. In the automatic mode, a laundering operation is initiated upon receiving a single cycle input parameter from the user, preferably through a LCD touch screen display, while relying on additional operating cycle parameters established by factory preset settings or prior consumer established preferences. In accordance with a preferred embodiment of the invention, a consumer need merely select a single cycle parameter, such as a type of stain adapted to be removed, and the appliance will start based on temperature and other setting parameters taken from memory. However, even with the automatic start feature activated, the user will still be able to adjust pre-established cycle parameters by changing default values after the cycle has started.

17 Claims, 6 Drawing Sheets

U.S. PATENT DOCUMENTS

| | | | | |
|---|---|---|---|---|
| 4,184,347 | A * | 1/1980 | Tobita et al. | 68/12.23 |
| 4,763,493 | A | 8/1988 | Nishite et al. | |
| 4,955,213 | A | 9/1990 | Ohsugi et al. | |
| 5,072,473 | A | 12/1991 | Thuruta et al. | |
| 5,124,908 | A | 6/1992 | Broadbent | |
| 5,293,760 | A | 3/1994 | Tani et al. | |
| 5,297,307 | A | 3/1994 | Baek | |
| 5,560,060 | A | 10/1996 | Dausch et al. | |
| 5,585,704 | A | 12/1996 | Elzind | |
| 5,644,936 | A | 7/1997 | Yasutake et al. | |
| 5,694,793 | A | 12/1997 | Nishimura et al. | |
| 5,799,281 | A * | 8/1998 | Login et al. | 705/1 |
| 5,897,671 | A | 4/1999 | Newman et al. | |
| 5,956,487 | A | 9/1999 | Venkatraman et al. | |
| 6,173,239 | B1 | 1/2001 | Ellenby | |
| 6,327,730 | B1 * | 12/2001 | Corbett | 8/158 |
| 6,553,594 | B2 * | 4/2003 | Broker et al. | 8/158 |
| 6,594,841 | B2 * | 7/2003 | Broker et al. | 8/159 |
| 6,885,317 | B1 * | 4/2005 | Gutowitz | 341/22 |
| 6,934,592 | B2 * | 8/2005 | Hood et al. | 700/83 |
| 2004/0107510 | A1 * | 6/2004 | Buckroyd et al. | 8/159 |
| 2004/0134238 | A1 * | 7/2004 | Buckroyd et al. | 68/12.23 |

FOREIGN PATENT DOCUMENTS

| | | |
|---|---|---|
| JP | 401223996 | 9/1989 |
| JP | 5345090 | 12/1993 |

OTHER PUBLICATIONS

"Natural Choices" Website, www.execpc.com, Natural Choices.
"FabricLink's Stain Removal Guide" holiday edition, www.fabriclink.com.

* cited by examiner

LAUNDRY APPLIANCE HAVING AUTOMATIC START FEATURE BASED ON SELECTED STAIN

CROSS-REFERENCE TO RELATED APPLICATIONS

The present application presents a continuation-in-part of U.S. patent application Ser. No. 09/919,793 filed Aug. 2, 2001 now U.S. Pat. No. 6,671,916 and entitled "Laundry Appliance Having Automatic Start Feature," and also a continuation-in-part of U.S. patent application Ser. No. 09/741,067 filed Dec. 21, 2000 entitled "Interactive Control System For a Laundry Appliance," now U.S. Pat. No. 6,502,265.

BACKGROUND OF THE INVENTION

1. Field of the Invention

The present invention pertains to the art of appliances and, more particularly, to a laundry appliance which can be selectively operated in an automatic mode wherein a laundering cycle is initiated with minimum input from a user, while subsequent cycle modifications can still be made.

2. Discussion of the Prior Art

In order to operate a laundry appliance, i.e., either a clothes washer or dryer, it is necessary for a user to initially select various cycle parameters. For instance, in order to establish a desired washing operation in a clothes washing machine, typically required selections include the water level, water temperature, type of fabric and cycle duration. In most clothes washers, buttons and/or rotatable dials are employed for these programming purposes.

In many instances, a particular user of a washing machine will establish common operating parameters between successive cycles for the same type of fabrics. For example, it would not be uncommon for a user to almost consistently select large water level, hot wash/warm rinse and heavy soil wash time settings when washing white cotton clothing items. However, these settings will almost invariably be altered before a washing operation of the same type of garments is performed. In other words, the washing of whites will typically be followed by the washing of colors or dark clothing which will require the settings to be altered. Therefore, it is not uncommon for the user to need to customize nearly every available parameter setting for each washing operation performed, even though the settings used for the same type of fabrics tend to be consistent.

Certainly, the need to change the various operating parameters for each washing operation represents some level of inefficiency. To address this problem, it has been proposed to automate an overall washing operation. Examples of known automatic washing machine arrangements are represented by the disclosures in U.S. Pat. Nos. 5,072,473, 5,297,307, 5,293,760 and 5,694,793, each of which provides for a fully automatic operating mode wherein a washing operation can be performed with minimum required input. For instance, in accordance with U.S. Pat. No. 5,072,473, a cycle can be started for washing an object placed in a drum of a washing machine upon selecting one of "heavily soiled", "standard" and "lightly soiled" modes, along with any desired pre-washing operations. The '307 patent is directed to a washing machine including both manual and automatic washing features. Upon the selection of the automatic washing feature, the appliance analyzes a series of stored washing factors accumulated from the operation of the machine in a manual mode and, through a self-learning sequence, determines final washing factors to be implemented during the automatic operation. In accordance with U.S. Pat. No. 5,293,760, a washing operation can be initiated by a consumer upon the selection of only a start button. Finally, in the '793 patented arrangement, an automatic washing cycle will be commenced following receipt of inputs concerning the type of washing cycle to be performed. In any event, the purpose of these types of arrangements is to minimize the required number of inputs by the user to perform a washing operation.

To perform these automatic functions, sensors are commonly employed to specifically detect certain parameters which would otherwise need to be inputted by the user. For example, the washer disclosed in the '473 patent utilizes at least a cloth amount sensor to detect a quantity of an object being washed. In a somewhat corresponding manner, the '760 patented arrangement detects, among other factors, a washing quantity, cloth characteristics and entanglement characteristics of the wash load. In any event, although these prior art arrangements advantageously enable a washing operation to be performed with a minimum number of inputs, employing complicated sensor structure to compensate for the lack of user inputs is seen to represent a costly alternative. In addition, these arrangements are seen to be disadvantageous in that, after a particular washing cycle has been initiated, the user is refrained from altering the overall cycle parameters.

Based on at least these reasons, there exists a need in the art for a cost effective and efficient control system for a laundry appliance which will enable an entire cycle to be performed with a minimum amount of input on the part of the user. More particularly, there exists a need in the art for a laundry appliance which can be programmed, either during manufacture or by a user, to perform common cycles with minimum input by the user, while still enabling the cycles to be altered after initiation thereof.

SUMMARY OF THE INVENTION

The present invention is directed to establishing an automatic start feature in a laundry appliance whereby a laundering operation can be initiated with minimum input by the user. More specifically, the laundry appliance can store typical operating cycles for different types of fabrics or stains, either based on factory settings or consumer established preferences, in order to enable the appliance to start immediately following a selection of a single cycle parameter. In accordance with a preferred embodiment of the invention, a consumer need merely select a particular fabric or stain type and the appliance will start based on temperature and other setting parameters taken from memory. However, even with the automatic start feature activated, the user will still be able to adjust pre-established cycle parameters by changing default values after the cycle has started.

In accordance with one aspect of the invention, the "auto start" feature can be selectively turned either OFF or ON. Therefore, the laundry appliance can be selectively operated in either manual or automatic modes. If the OFF mode is selected, the user will be required to input all necessary information to initiate a desired cycle. In the ON mode, factory settings, as modified based on consumer preferences either before or after initiating a particular washing operation, will be employed. In its most preferred form, the invention is incorporated in a clothes washing machine and, more particularly, a washing machine incorporating an LCD touch screen display.

Additional objects, features and advantages of the present invention will become more readily apparent from the following detailed description of a preferred embodiment when taken in conjunction with the drawings wherein like reference numerals refer to corresponding parts in the several views.

DETAILED DESCRIPTION OF THE PREFERRED EMBODIMENT

Figure 1:
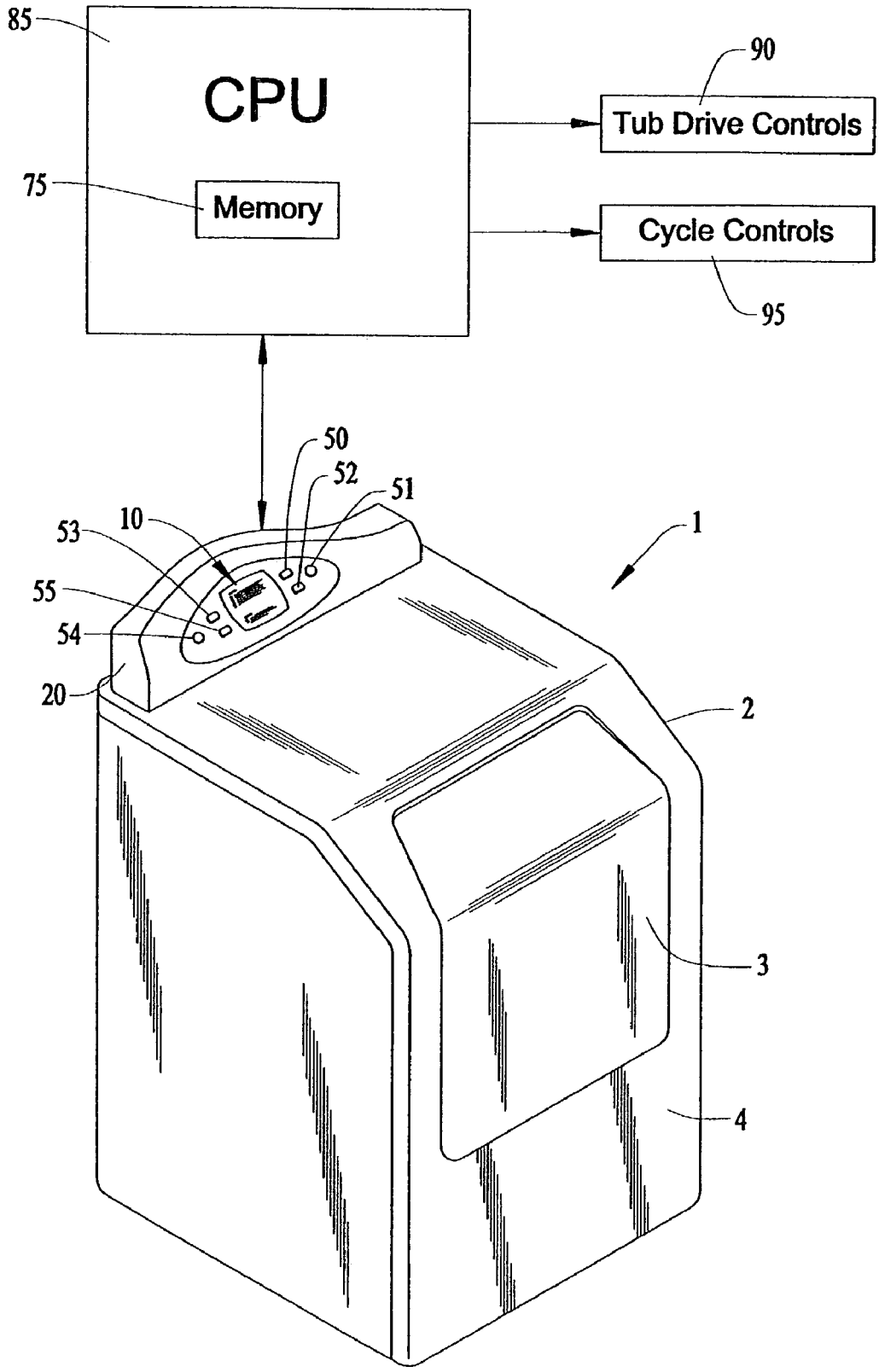
FIG. 1 is a perspective view of a clothes washing machine incorporating a touch screen display and the auto-start feature of the invention.

With initial reference to FIG. 1, a laundry appliance 1 is schematically shown in the form of a washing machine. Appliance 1 includes a cabinet 2 provided with a door 3 in a front face 4. Door 3 is designed to be pivoted to expose an integral washing tub (not shown). A display 10 is integrated into a control panel 20 through which a user can control and program washing appliance 1 as will be detailed below. Appliance 1 also includes various control buttons 50-56 shown about display 10.

In accordance with a preferred embodiment of the invention, an "OFF" button 50 is provided to selectively turn off or reset laundry appliance 1. Button 51 constitutes a "START/PAUSE" button used to initiate or pause a selected washing operation. A "HELP" button 52 is provided to enter a help control mode as will be discussed further below. A "HOME" button 53 is used to enter another control mode which will also be discussed fully below. Button 54 enables direct access to "FAVORITES" relating to preferred cycle parameters stored by a user in a memory 75 of a CPU 85 used to regulate tub drive controls, generally indicated at 90, and cycle controls 95. Finally, a "BACK" button 55 is provided to erase an inadvertently inputted control parameter or revert back to a prior screen on display 10. As will also become more fully evident below, the particular control configuration for laundry appliance 1 can significantly vary in accordance with the present invention.

The present invention is directed to the selective use of laundry appliance 1 in either manual or automatic modes of operation. Although the input of cycle parameters for a desired washing operation can be accomplished in many different ways in accordance with the present invention, in the preferred embodiment, the input of cycle parameters is performed through display 10. That is, in the most preferred form of the invention, display 10 takes the form of an LCD touch screen, such as a 128×96 dot matrix, touch screen display, which enables a user to readily review displayed data, preferably in alpha or word text format, and select from that data to establish and begin a desired washing operation, as well as retrieve a wide range of information regarding appliance 1.

Figure 2A:
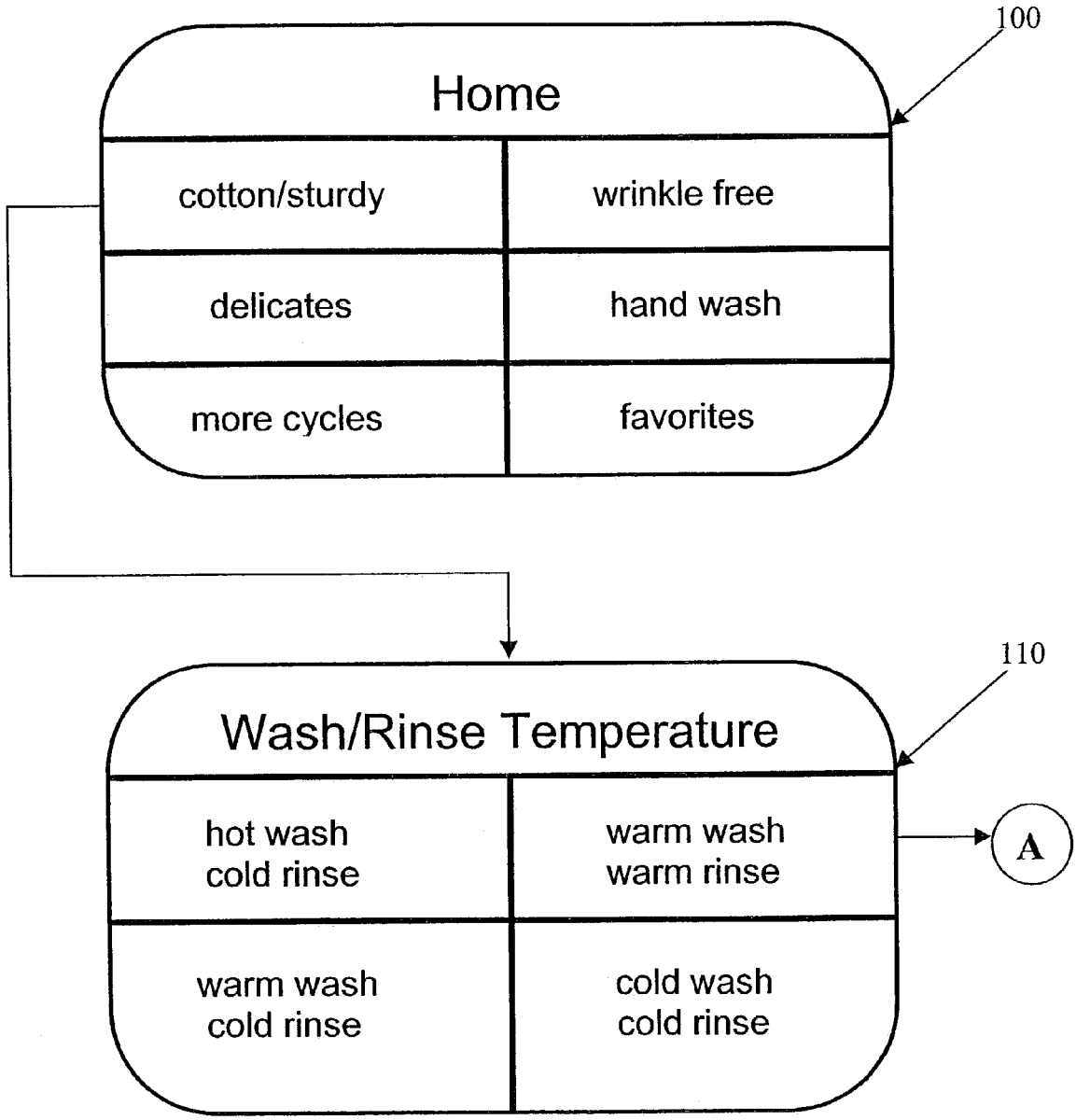
FIG. 2A is a diagrammatic representation of a portion of an operating screen sequence employed in accordance with a preferred embodiment of the invention.
Figure 2B:
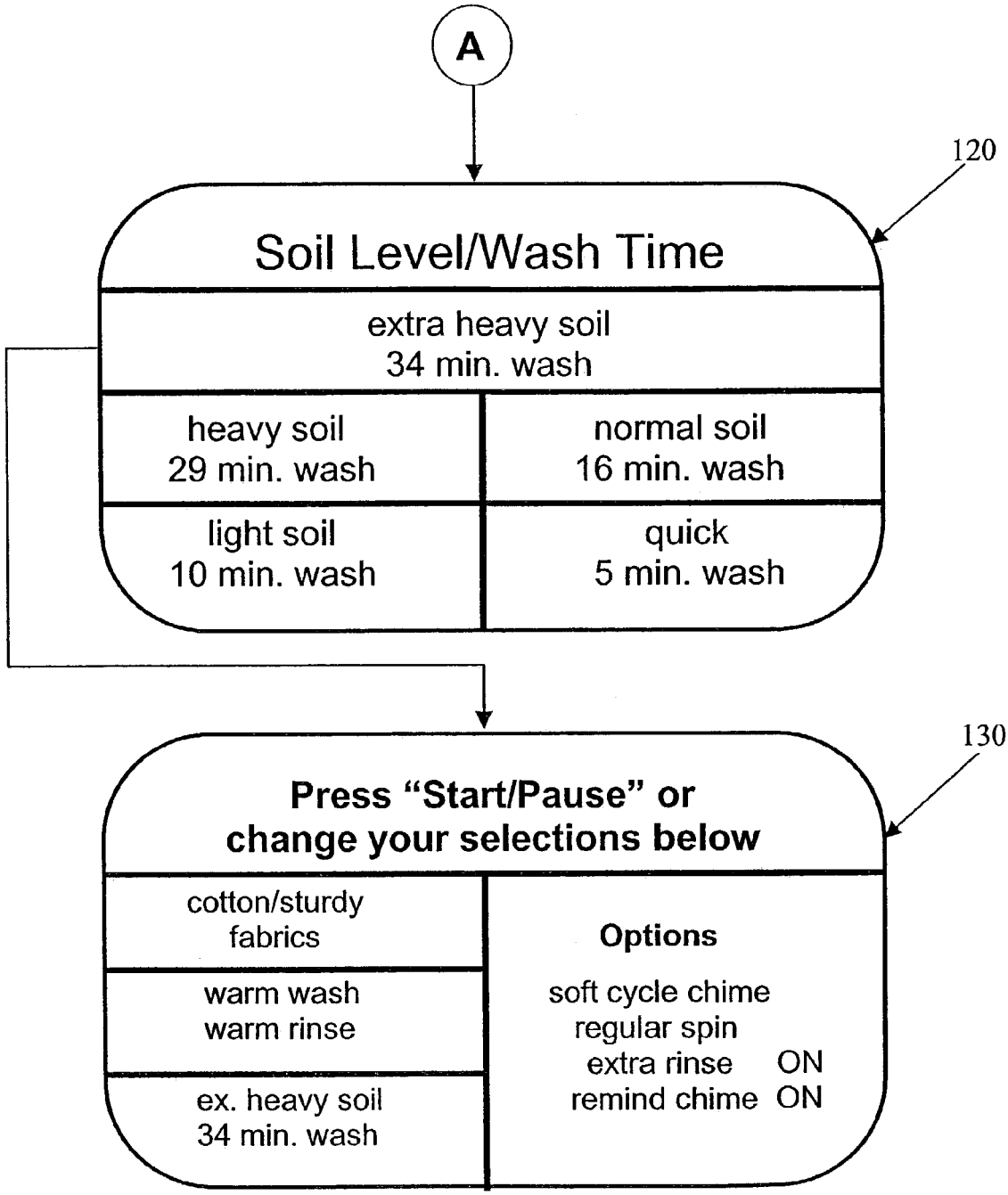
FIG. 2B is a diagrammatic representation of additional operating screens in the overall sequence of FIG. 2A.

In any event, FIGS. 2A and 2B depict a preferred programming sequence used to illustrate the manner in which potential cycle inputs are presented to a user for selection in a manual mode of operation for laundry appliance 1. In general, in the manual mode of operation, the user is required to input at least the particular fabric type, wash/rinse temperature and soil level/wash time before initiating a washing operation. To this end, screen 100 is initially presented to the user on display 10 upon pressing "HOME" button 53. As shown, screen 100 preferably presents various fabric type options for laundry appliance 1. With screen 100 displayed, the user can select a desired cycle input by simply touching the corresponding portion of display 10. As shown, the user is provided with the option of selecting between "cotton/sturdy", "wrinkle free", "delicates" or "hand wash" fabric types.

On the other hand, the user could select "more cycles" for other potential wash and/or special rinse cycles. The "favorites" option is preferably provided in connection with enabling a user to store desired cycle parameters relating to specific loads which are continuously washed. For example, the user of laundry appliance 1 may have uniforms or grass-stained clothing that need to be periodically washed utilizing a consistent set of wash cycle parameters. Therefore, instead of requiring the user to re-input the overall set of wash cycle parameters each time, these "favorites" can be stored in memory 75 of CPU 85 for easy access. Since the programming of laundry appliance 1 in this manner is not considered part of the present invention, it will not be discussed further herein.

In the example provided, the user has selected the "cotton/sturdy" fabric type through screen 100. This selection causes display 10 to automatically convert to screen 110 in order to enable the user to input a desired wash/rinse temperature. As shown, the user preferably can select between "hot wash/cold rinse", "warm wash/warm rinse", "warm wash/cold rinse" and "cold wash/cold rinse" options. For exemplary purposes, the "warm wash/warm rinse" option has been selected which causes screen 120 as shown in FIG. 2B to be presented on display 10. Screen 120 enables the final, required cycle parameter, i.e., the soil level/wash time, to be selected. Again, although shown just with respect to a preferred embodiment of the invention, the user has the option of selecting between "extra heavy soil—34 min. wash", "heavy soil—29 min. wash", "normal soil—16 min. wash", "light soil—10 min. wash" and "quick—5 min. wash". As shown, the "extra heavy soil—34 min. wash" option has been selected, thereby resulting in the presentation of screen 130 in display 10. As shown by screen 130, it is desired in accordance with the invention to provide the user with a summary of selected cycle parameters, as well as a list of further options which could be established by the user based on personal preferences. If the collective cycle parameters are approved by the user, the depression of "START/PAUSE" button 51 will initiate the laundering operation. If changes are desired, the particular selected parameter can be highlighted through screen 130 or "BACK" button 55 can be used to revert back to prior selection screens.

Figure 3:
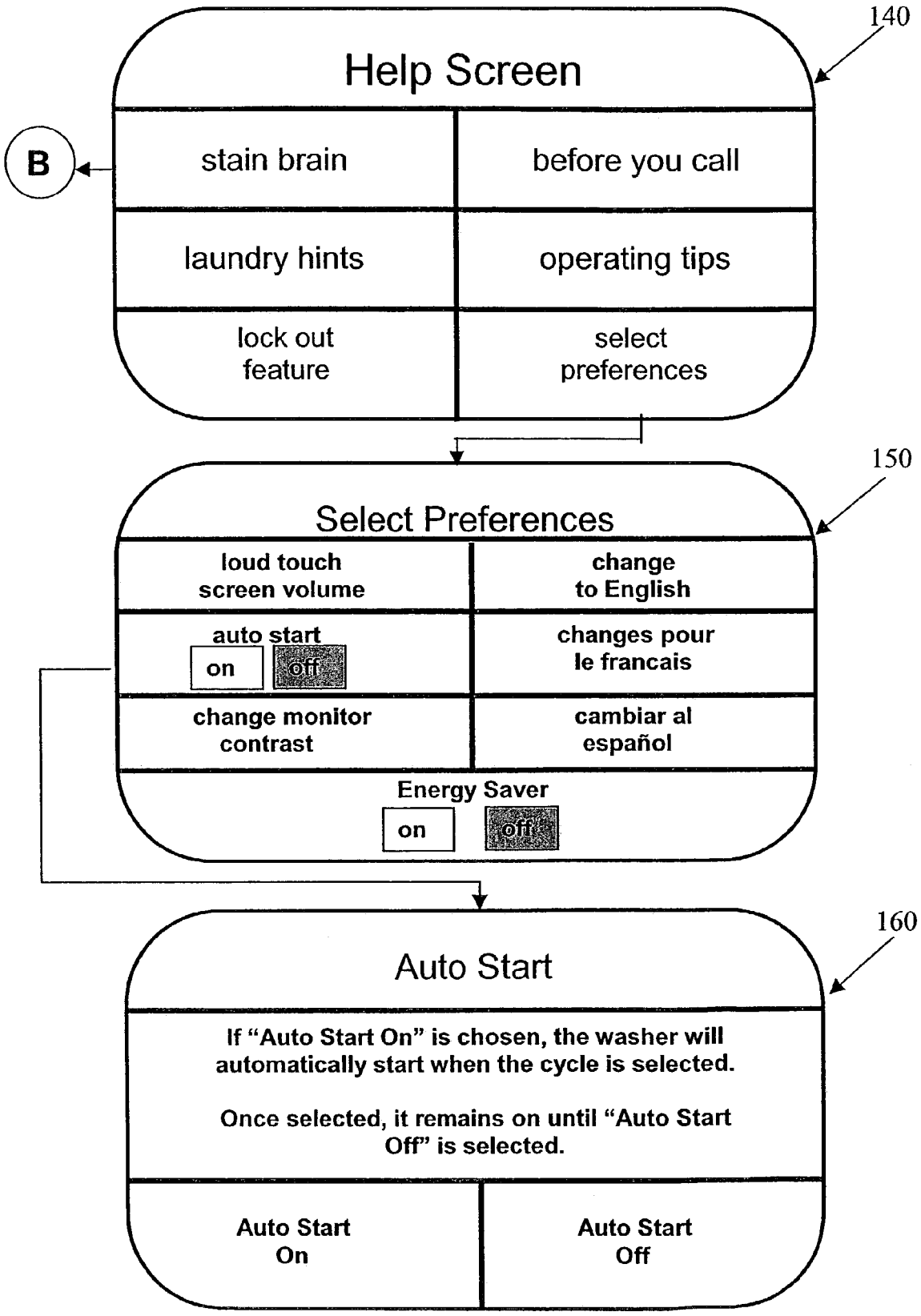
FIG. 3 is a diagrammatic representation of another operating screen sequence employed in accordance with the invention.

Again, the manual input sequence described above is employed when the user does not activate the automatic washing mode. Preferably, laundry appliance 1 is set with the automatic mode defaulted to OFF. However, the user has the option of switching laundry appliance 1 to the automatic mode. By depressing "HELP" button 52, the user will be presented with screen 140 as shown in FIG. 3. For purposes of the present invention, although various help selections are available, it is assumed that the user has chosen "Select Preferences", thereby resulting in screen 150 in display 10. As shown, screen 150 can be utilized to alter the volume, language, monitor contrast and energy related features which are preferably incorporated into laundry appliance 1 but not encompassed by the present invention. More importantly, screen 150 includes an "auto start" preference selection. In the preferred embodiment, the auto start feature can be toggled between ON/OFF states. Screen 150 shows the auto start feature in the OFF position. However, upon selecting the auto start feature in screen 150, screen 160 will be presented. Screen 160 preferably provides the user with a brief instruction concerning the auto start feature and enables the user to toggle between the ON/OFF states.

If the "Auto Start On" feature is selected, the user is only required to input a minimum number of desired cycle parameters in order to initiate a laundering operation. For instance, in the automatic mode of operation, when the user arrives at screen 100 and selects the "cotton/sturdy" fabric type, laundry appliance 1 will automatically initiate a washing operation. Therefore, in accordance with the most preferred form of the invention, a minimum of one cycle input parameter needs to be selected by the user. The remaining, necessary cycle input parameters will be taken from default values stored in memory 75. In accordance with a first embodiment of the invention, these default values are factory preset. In accordance with another embodiment, the cycle parameter selections made by the user during a previous laundering operation in the manual mode, in which the same fabric type was selected, are employed. In either case, the time required for the user to program laundry appliance 1 and initiate the laundering operation is greatly reduced versus the manual mode of operation.

Although the need to select more than one required cycle parameter while in the automatic mode of operation is avoided, the present invention specifically enables the user to still alter the default parameters following initiation of the laundering operation. Therefore, although the laundering operation will be automatically started upon pressing "cotton/sturdy" in screen 100 in accordance with the example provided, the user is still able to adjust the wash/rinse temperature, soil level/wash time and/or any of the remaining option selections while laundry appliance 1 is running. This determination by the user can be easily made, particularly with the user still being provided with a summary of the various settings in display 10. Of course, if all of the settings are satisfactory, no further input by the user is required.

Performing an automatic washing operation in accordance with the present invention can also be accomplished with the aid of washing performance tips and cycle parameters which are based on a particular stain of concern that is entered by selecting the "Stain Brain" option from screen 140 of FIG. 3. For instance, the user can be presented with common types of stains or an alphabet listing used to input spelling information on a common stain and, by selecting the specific stain type, suggestions for best cleaning of that type of stain. This general arrangement is disclosed in co-pending U.S. patent application Ser. No. 09/741,067 entitled "Interactive Control System for a Laundry Appliance" which is hereby incorporated by reference.

Figure 4A:
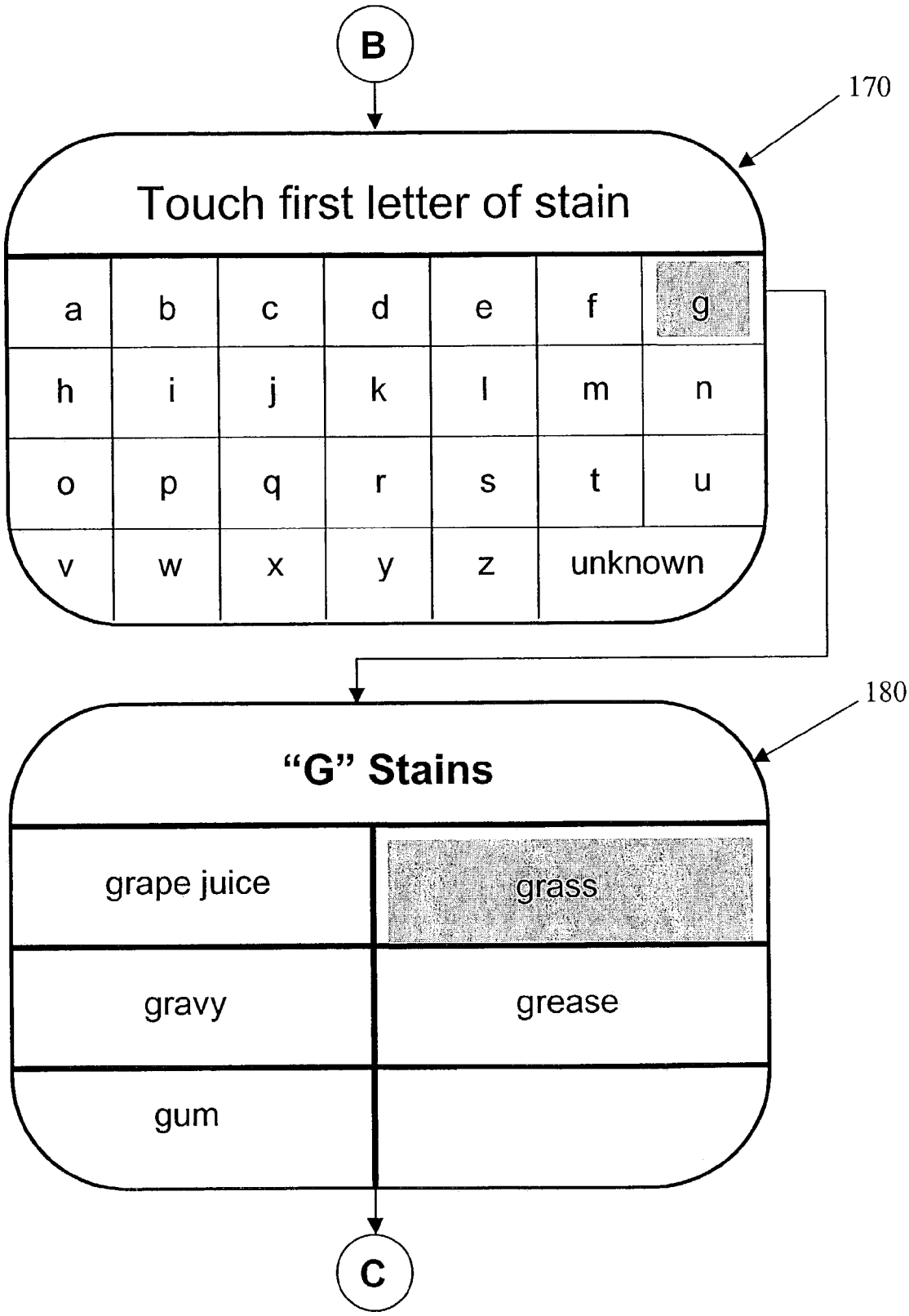
FIG. 4A is a diagrammatic representation of a portion of a stain screen sequence employed with the invention.

More specifically, in accordance with the most preferred form of the invention shown in FIG. 4*a*, an alphabet listing (alpha) screen 170 is presented upon selecting the "Stain Brain" option from screen 140. By way of example, screen 170 indicates that the user has selected the letter "g" which results in screen 180 being depicted. Here, the user is shown pre-programmed stain types starting with the selected letter. In this example, the user is presented with selecting between "grape juice", "gravy", "gum", "grass" and "grease" stains. Of course, this listing is not intended to be limiting, but rather exemplary for purposes of explaining the invention. If the user does not known how to spell the particular stain or simply does not known what the particular stain is, "unknown" can be selected to either enable the user to scroll through various stains or to be provided with some with generic pre-treating instructions.

Figure 4B:
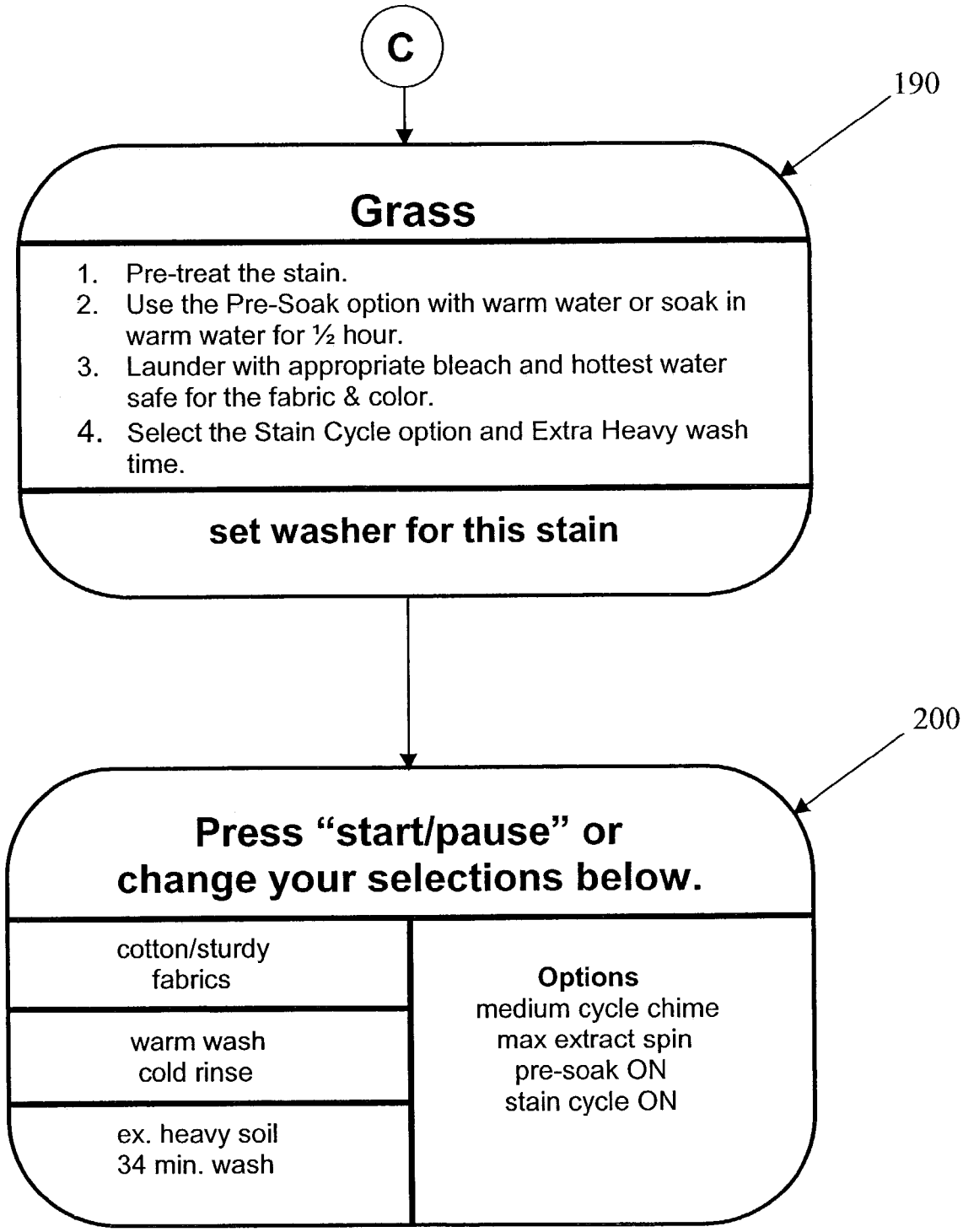
FIG. 4B is a diagrammatic representation of another portion of the stain screen sequence of FIG. 4A.

At this point, it is assumed that the user has selected "Grass" as the particular stain under consideration. This leads to screen 190 shown in FIG. 4*b*. Screen 190 presents the user with certain, recommended pre-wash treatments based on the stain selected. In the instant case, the user is recommended to pre-treat the stain, employ a pre-soak option utilizing warm water or to soak the grass stained garment in warm water for a certain time period. Thereafter, the garment should be laundered with bleach and hot water. Screen 190 also instructs the user to select a stain cycle option which, although not shown, is available under "more cycles" in screen 100. On the other hand, in furtherance of the desire to minimize required inputs by the user in accordance with the invention, the user can simply press the bottom portion of screen 190 to set laundry appliance 1 for the selected stain.

Next, screen 200 is preferably presented to the user. Actually, screen 200 provides the user with the same options as screen 130 of FIG. 2B. More specifically, screen 200 enables a review of the selections established for the particular stain prior to starting a washing operation. At this point, the user can make desired option and cycle changes, or simply start laundry appliance 1 for an automatic start operation.

Based on the above, it should be realized that, not only is the user aided by providing additional help screens to enable recommendations for removing a specified stain to be displayed, but the user is provided the option of auto-starting laundry appliance 1 upon indicating the stain of concern to appliance 1 in accordance with the invention. Again, although only a select number of specific stain types have been discussed, a variety of additional stain types are encompassed, with laundry appliance 1 being pre-programmed with advantageous operating parameters for each of the types of stains. For instance, if a "b" is selected in screen 170, stains covering "baby formula", "blood", "beverages", "butter" and the like are preferably displayed. Additionally or in the alternative, the user may be presented with an algorithm used to determine the type of stain. Furthermore, if the user encounters a particular stain frequently, the particular washing operation can be saved as a "favorite" cycle.

In any event, it should be readily apparent that the present invention advantageously provides for a laundry appliance 1 which can be selectively operated in differing modes. If the user tends to frequently run the same type of cycle, the automatic mode of operation is considered to be particularly advantageous. In any case, it is important to note that the most preferred embodiments of the present invention do not employ expensive sensor arrangements to determine or calculate necessary cycle input parameters such that an efficient, yet cost effective arrangement is provided. In addition, it is considered a particularly advantageous feature of the invention to enable cycle parameters to still be altered by the user after a laundering operation is already initiated in the automatic mode of operation.

Although described with reference to preferred embodiments of the invention, it should be readily understood that various changes and/or modifications can be made to the invention without departing from the spirit thereof. For instance, although the fabric type is a preferred setting selection received from the user in accordance with the invention, it should be realized that the actual cycle parameter that needs to be inputted by the user in order to initiate the laundering operation in the automatic mode could be varied. In addition, to supplement screen text displayed to a user, motion graphics can also be employed. For instance, screen 190 can be supplemented with graphics illustrating the pre-treating of an article of clothing, the pre-soaking thereof, and the like. Furthermore, instead of or in addition to having stain information and associated cycle parameters therefor stored in the laundry appliance, the laundry appliance could be linked to a remote source inside a home, or a server of a remote network. In general, the invention is only intended to be limited by the scope of the following claims.

We claim:

1. A laundry appliance comprising:

means for inputting a particular stain to be addressed in a laundering operation;

means for automatically establishing a laundering operation based on the particular stain in combination with additional, default parameters; and means for selectively turning an automatic start feature, which controls whether the laundry appliance performs the laundry operation based only on the particular stain in combination with the additional, default parameters, on and off wherein, when the automatic start feature is off, the laundry appliance operates in a first mode wherein the user must select between various soil levels of the laundry in order to initiate the laundry operation and, when the automatic feature is on, the laundry appliance operates in a second mode wherein the laundry operation can be automatically started based on the particular stain selection and the default parameters, while a selection between the various soil levels is avoided.

2. The laundry appliance according to claim 1, wherein the laundry appliance has the default parameters factory pre-installed therein.

3. The laundry appliance according to claim 1, further comprising: means for pre-programming the default parameters in the laundry appliance by the user.

4. The laundry appliance according to claim 1, further comprising: means for displaying a user with a list of stains from which the particular stain can be selected.

5. The laundry appliance according to claim 4, wherein the displaying means presents an alpha screen to the user for use in establishing the particular stain.

6. The laundry appliance according to claim 5, wherein the displaying means provides the list of stains after the user selects a letter from the alpha screen corresponding to the particular stain.

7. The laundry appliance according to claim 6, wherein the displaying means presents the user with a series of pre-treating instructions to the user prior to initiating the laundering operation.

8. The laundry appliance according to claim 4, wherein the displaying means comprises a screen integrated into the laundry appliance.

9. The laundry appliance according to claim 8, wherein the screen comprises an LCD touch screen.

10. The laundry appliance according to claim 1, wherein the inputting means enables the particular stain to be inputted as a grass or grease stain.

11. The laundry appliance according to claim 1, wherein the additional, default parameters are pre-established for the particular stain and vary depending upon the particular stain inputted.

12. A laundry appliance comprising:

a cabinet adapted to receive articles of clothing for a laundry operation;

a control panel enabling a user to program the laundry appliance for the laundry operation, said control panel including a display through which a user can make a particular stain selection based on a particular stain to be addressed in the laundry operation, wherein the display is configured to present a user with multiple lists of different stains from which the particular stain selection can be made; and a controller linked to the control panel for receiving the particular stain selection for the laundry operation, said controller including a memory having stored therein various default parameters for the laundry operation, wherein the controller enables the laundry operation to be automatically started based on the particular stain selection and the default parameters.

13. The laundry appliance according to claim 12, wherein the display is configured to present an alpha screen to the user for use in establishing the list of stains, wherein the display provides the list of stains after the user selects a letter from the alpha screen.

14. The laundry appliance according to claim 12, wherein the display constitutes an LCD touch screen.

15. The laundry appliance according to claim 12, further comprising: means for selectively turning an automatic start feature, which controls whether the laundry appliance performs the laundry operation based only on the particular stain in combination with the default parameters, on and off.

16. A laundry appliance comprising:

a cabinet adapted to receive articles of clothing for a laundry operation;

a control panel enabling a user to program the laundry appliance for the laundry operation, said control panel including a display through which a user can make a particular stain selection based on a particular stain to be addressed in the laundry operation, wherein the display enables the user to input the particular stain as a grass or grease stain; and a controller linked to the control panel for receiving the particular stain selection for the laundry operation, said controller including a memory having stored therein various default parameters for the laundry operation, wherein the controller enables the laundry operation to be automatically started based on the particular stain selection and the default parameters.

17. The laundry appliance according to claim 12, wherein the control panel enables a user to alternatively operate the laundry appliance in a first mode of operation wherein the user must select between various soil levels of the laundry in order to initiate the laundry operation and a second mode wherein the laundry operation can be automatically started based on the particular stain selection and the default parameters, while a selection between the various soil levels is avoided.

* * * * *